US008513551B2

(12) United States Patent
Ohta

(10) Patent No.: US 8,513,551 B2
(45) Date of Patent: Aug. 20, 2013

(54) INTERLOCK MECHANISM AND IMAGE FORMING APPARATUS

(75) Inventor: Yoshihide Ohta, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 232 days.

(21) Appl. No.: 13/067,832

(22) Filed: Jun. 29, 2011

(65) Prior Publication Data

US 2012/0012445 A1 Jan. 19, 2012

(30) Foreign Application Priority Data

Jul. 14, 2010 (JP) ..... 2010-159912

(51) Int. Cl.
*H01H 9/22* (2006.01)

(52) U.S. Cl.
USPC ..... 200/50.12; 200/61.7; 200/61.81

(58) Field of Classification Search
USPC ..... 200/50.12, 50.1, 61.7–61.76, 61.81
See application file for complete search history.

(56) References Cited

U.S. PATENT DOCUMENTS

| | | | | |
|---|---|---|---|---|
| 7,141,750 | B2 * | 11/2006 | Yamada | 200/341 |
| 7,511,238 | B2 * | 3/2009 | Sugane et al. | 200/61.62 |
| 7,751,751 | B2 | 7/2010 | Ohta et al. | |
| 7,873,303 | B2 | 1/2011 | Ohta et al. | |
| 7,878,725 | B2 | 2/2011 | Ohkubo et al. | |
| 7,937,028 | B2 | 5/2011 | Ogawa et al. | |
| 8,084,702 | B2 * | 12/2011 | Kawarago | 200/50.1 |
| 8,311,438 | B2 * | 11/2012 | Onuma et al. | 399/90 |
| 8,334,469 | B2 * | 12/2012 | Takenaka | 200/50.02 |
| 2007/0279888 | A1 | 12/2007 | Nanno et al. | |
| 2007/0285701 | A1 | 12/2007 | Ohta et al. | |
| 2008/0006166 | A1 | 1/2008 | Ohkubo et al. | |
| 2008/0175620 | A1 | 7/2008 | Ohta et al. | |
| 2008/0180760 | A1 | 7/2008 | Andoh et al. | |
| 2008/0180762 | A1 | 7/2008 | Andoh et al. | |
| 2008/0181695 | A1 | 7/2008 | Andoh et al. | |
| 2008/0181698 | A1 | 7/2008 | Andoh et al. | |
| 2008/0291501 | A1 | 11/2008 | Shiraki et al. | |
| 2008/0317498 | A1 | 12/2008 | Andoh et al. | |
| 2009/0022516 | A1 | 1/2009 | Ohta et al. | |
| 2009/0074495 | A1 | 3/2009 | Shiraki et al. | |
| 2009/0122330 | A1 | 5/2009 | Andoh et al. | |
| 2009/0162082 | A1 | 6/2009 | Shiraki et al. | |
| 2010/0021211 | A1 | 1/2010 | Ogawa et al. | |
| 2010/0052252 | A1 | 3/2010 | Ohta | |
| 2011/0026961 | A1 | 2/2011 | Ohta et al. | |
| 2011/0214972 | A1 * | 9/2011 | Shimizu | 200/335 |

FOREIGN PATENT DOCUMENTS

| | | |
|---|---|---|
| JP | 3754777 | 12/2005 |
| JP | 2008037054 A | 2/2008 |
| JP | 2009037997 A | 2/2009 |

* cited by examiner

*Primary Examiner* — Xuong Chung Trans
(74) *Attorney, Agent, or Firm* — Harness, Dickey & Pierce, P.L.C.

(57) ABSTRACT

An interlock mechanism includes first and second covers hinged to an apparatus body and openably closable relative to the apparatus body, an interlock switch provided inside the first and second coverts in the apparatus body, first and second pressing portions respectively provided on the first cover and the second cover, a first cam unit pivotably supported on the apparatus body by a first shaft to contact the first pressing portion, and a second cam unit pivotably supported on the first cam unit by a second shaft to contact the second pressing portion. When the first and second pressing portions respectively contact the first cam unit and the second cam unit, the first and second cam units rotate to push the interlock switch, the second cam unit turns on the interlock switch, and the closing of the first and second covers are detected simultaneously.

12 Claims, 9 Drawing Sheets

INTERLOCK MECHANISM AND IMAGE FORMING APPARATUS

CROSS-REFERENCE TO RELATED APPLICATIONS

This patent specification is based on and claims priority from Japanese Patent Application No. 2010-159912, filed on Jul. 14, 2010 in the Japan Patent Office, which is hereby incorporated by reference herein in its entirety.

BACKGROUND OF THE INVENTION

1. Field of the Invention

The present invention generally relates to an interlock mechanism and an image forming apparatus, such as a copier, a printer, a facsimile machine, or a multifunction machine capable of at least two of these functions, that incorporates the interlock mechanism.

2. Description of the Background Art

Image forming apparatuses having an openably closable cover that opens and closes relative to an apparatus body generally include as a safety measure an interlock mechanism to deactivate the apparatus when the cover is opened, securing the safety of users. In particular, image forming apparatuses typically include multiple covers because the direction in which sheets of recording media are transported and the direction in which consumables are inserted into the apparatus are different. These covers are opened during replacement of consumables or removal of jammed sheets. When any one cover is opened, however, it is difficult to physically block access to all hazardous components, such as motors, high-pressure components, and laser beam paths, inside the apparatus. Therefore, interlock mechanisms that operate in conjunction with opening and closing of the cover are used. Although a micro switch may be provided for each cover when the apparatus includes multiple covers to deactivate the apparatus when any cover is opened, using multiple micro switches is not desirable.

In view of the foregoing, several approaches described below have been tried. For example, JP-3754777-B proposes a single lever that moves when pushed in two different directions. When a first cover and a second cover are closed, the lever is moved to a position to push the micro switch of the interlock mechanism, turning it on. This approach, however, has several drawbacks. For example, because the operational range of an actuator to turn on and of the micro switch is as small as several millimeters, in such a configuration, over strokes of the cover that is closed or variations in the size of components cannot be absorbed, resulting in deformation of or damage to the micro switch.

To overcome this problem, JP-2008-037054-A proposes an actuator that moves in a direction different from a direction in which the cover moves when the cover is fully closed so that no abrupt force is applied to the micro switch when the cover is closed. Still, as described above severe limitations in the operational range of the actuator to turn on the switch remain with this approach also, and it is possible that an excessive load is applied to the switch, deforming or damaging the switch due to variations in the size of components for pushing the micro switch or torsion of the cover.

Additionally, JP-2009-37997-A proposes an interlock mechanism that includes a pivotable first lever, a second lever pivotably supported on the first lever, and first and second activation portions to selectively rotate the first and the second lever when the cover is closed. The first and second activation portions rotate along the direction in which the cover moves and include cam-shaped contact portions that contact the first and second levers, respectively. However, such complexity makes the mechanism vulnerable to unstable switch operation due to imprecise machining of constituent parts.

SUMMARY OF THE INVENTION

In view of the foregoing, in one illustrative embodiment of the present invention, an interlock mechanism includes a first cover hinged to an apparatus body and openably closable relative to the apparatus body, a second cover hinged to the apparatus body and openably closable relative to the apparatus body, an interlock switch provided inside the first cover and the second cover in the apparatus body, a first pressing portion provided on the first cover, a second pressing portion provided on the second cover, a first cam unit pivotably supported on the apparatus body by a first shaft provided on the apparatus body, to contact the first pressing portion, and a second cam unit pivotably supported on the first cam unit by a second shaft, to contact the second pressing portion. When the first pressing portion contacts the first cam unit and the second pressing portion contacts the second cam unit, the first cam unit and the second cam unit rotate to push the interlock switch, the second cam unit turns on the interlock switch, and the closing of the first and second covers are detected simultaneously.

In another illustrative embodiment of the present invention, an image forming apparatus includes an image forming unit to form an image on a sheet of recording media and the above-described interlock mechanism.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
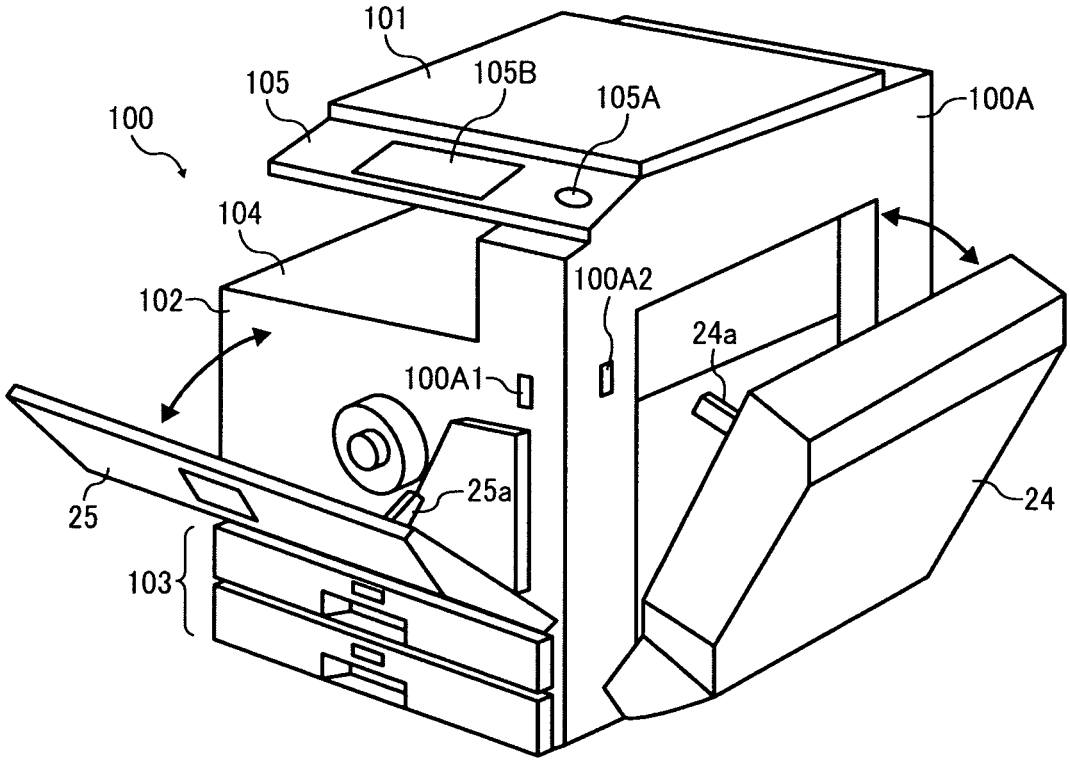
FIG. 1 is a perspective view that illustrates an overall structure of an image forming apparatus according to an illustrative embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an illustrative embodiment of the present invention is described.

FIG. 1 is a perspective view that illustrates an exterior of an image forming apparatus including an interlock mechanism according to an embodiment.

In FIG. 1, reference numeral 100 denotes the image forming apparatus. The image forming apparatus 100 includes a scanning unit 101 disposed above an apparatus body 100A, an image forming unit 102 housed in a vertical center portion in the apparatus body 100A in FIG. 1, a sheet feeder 103 disposed beneath the image forming unit 102, a sheet discharge portion 104 that is a space defined by the scanning unit 101 and an upper surface of the apparatus body 100A and positioned between the scanning unit 101 and the image forming unit 102 in a vertical direction, and an operation panel 105 projecting from a front side of the scanning unit 101 to a front side of the apparatus. The scanning unit 101 includes a document table, and the sheet feeder 103 includes multiple sheet cassettes for storing sheets of recording media. The operation panel 105 includes an operation button 105A and a liquid crystal display 105B.

Figure 2B:
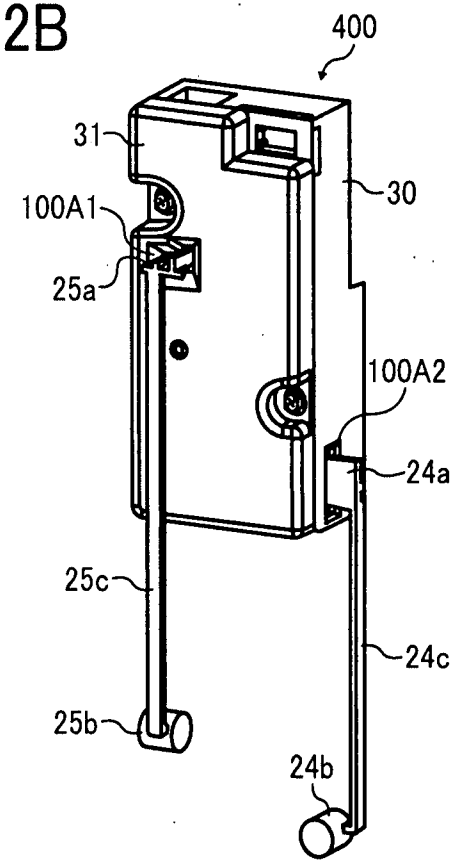
FIG. 2B is a perspective view of the interlock mechanism that illustrates a state in which those covers are closed.
Figure 2A:
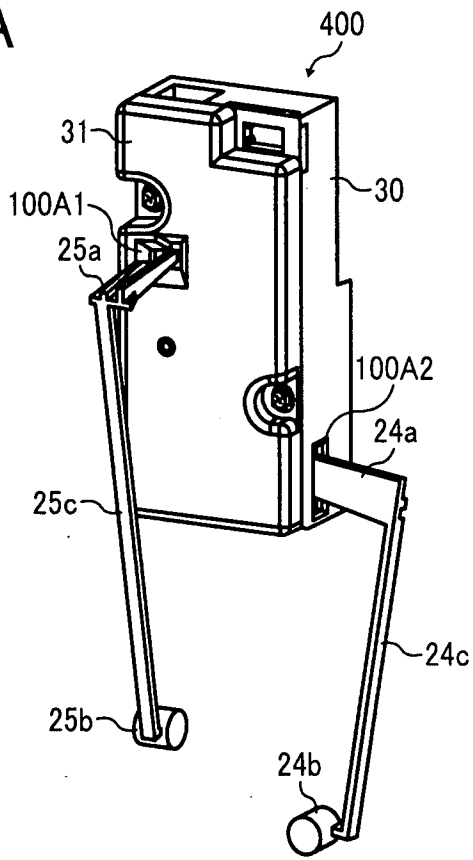
FIG. 2A is a perspective view of an interlock mechanism provided in the image forming apparatus shown in FIG. 1 and illustrates a state in which a front cover and a right cover are open.

A front cover 25, serving as a first cover, is provided on the front side of the apparatus body 100A, and a right cover 24, serving as a second cover, is provided on a side (right side in FIG. 1) perpendicular to the front side the apparatus body 100A. Lower portions of the front cover 25 and the right cover 24 are hinged to a lower portion of a housing of the apparatus body 100A. Thus, the front cover 25 and the right cover 24 can open relative to the apparatus body 100A by rotating about their lower portions as support points. Projections 24*a* and 25*a* serving as first and second pressing portions and projecting inward are respectively provided on an inner side of the right cover 24 and on an inner side of the front cover 25. As shown in FIGS. 2A and 2B, the projection 24*a* is provided at an end portion (an upper end in FIGS. 2A and 2B) of a support rod 24*c* attached to the right cover 24, and the projection 25*a* is formed at an end portion (an upper end in FIGS. 2A and 2B) of a support rod 25*c* attached to the front cover 25. The projections 24*a* and 25*a* are used in conjunction with opening and closing of the right cover 24 and the front cover 25, respectively.

Figure 3:
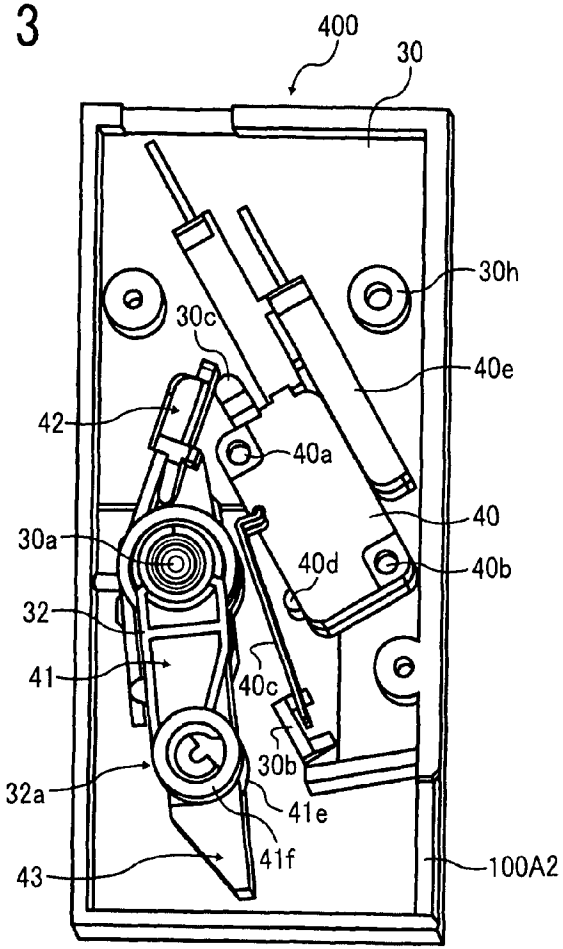
FIG. 3 is a front view that illustrates an interior of a switch activation device of the interlock mechanism.

The projection 25*a* provided on the inner side of the front cover 25 is shifted to the right cover 24. The projection 24*a* provided on the inner side of the right cover 24 is shifted to the front cover 25. Openings 100A1 and 100A2 into which the projections 25*a* and 24*a* are inserted are formed in the housing of the apparatus body 100A at respective positions facing the projections 25*a* and 24*a*. The opening 100A1 facing the projection 25*a* formed on the front cover 25 is positioned adjacent to an upper right corner on the front side adjacent and perpendicular to the right side, on which the right cover 24 is positioned. The opening 100A2 on the right side, facing the projection 24*a* formed on the right cover 24, is positioned close to an upper corner adjacent and perpendicular to the front side, on which the front cover 25 is positioned. Additionally, a switch activation device 400 shown in FIG. 3 is provided in an inner space enclosed by the openings 100A1 and 100A2.

FIGS. 2A and 3B illustrate the switch activation device 400 and related components. FIG. 2A illustrates a state in which the right cover 24 and the front cover 25 are open, and FIG. 2B illustrates a state in which the right cover 24 and the front cover 25 are closed.

The switch activation device 400 includes a housing frame 30 and an interior cover 31 for preventing the switch activation device 400 from being exposed when the front cover 25 is open and is provided inside space defined by the housing frame 30 and the interior cover 31. In the present embodiment, the housing frame 30 and a mold structure of the apparatus body 100A are formed as a single unit. In other words, the housing frame 30 and the interior cover 31 of the switch activation device 400 are parts of the housing of the apparatus body 100A of the image forming apparatus 100.

The opening 100A is formed in the interior cover 31, and the opening 100A2 is formed in the housing frame 30. The interior cover 31 is fixed in position relative to the housing frame 30 and screwed to the housing frame 30. Although the housing frame 30 may be constructed by crimping a shaft onto a plate frame, a resin housing frame is preferable because the number of shafts including those for positioning can be reduced. Accordingly, the cost can be reduced.

It is to be noted that reference characters 24*b* and 25*b* respectively denote shafts around which the right cover 24 and the front cover 25 pivot, positioned at the other end (a lower end in FIGS. 2A and 2B) of the support rod 24*c* and at the other end (a lower end in FIGS. 2A and 2B) of the support rod 25*c*.

A configuration of the switch activation device 400 is described in further detail below with reference to FIGS. 3 through 11.

FIG. 3 illustrates an interior of the housing frame 30 from which the interior cover 31 is removed.

As shown in FIG. 3, the switch activation device 400 includes the micro interlock switch 40 (hereinafter simply "interlock switch 40") supported on the housing frame 30, actuators 40*c* (40*c*1 and 40*c*2) to operate the interlock switch 40, a first cam unit 32, and a second cam unit 43. The first cam unit 32 is swingably supported on a shaft 30*a* (a first shaft), also shown in FIG. 8, provided on the housing frame 30 and includes a shaft 32*a* (second shaft) disposed in parallel to the shaft 30*a*, at a positioned different from the shaft 30*a*. Further, the shaft 32*a* of the first cam unit 32 is positioned adjacent to and facing an end portion of the actuator 40*c*. When the projection 25*a* of the front cover 25 contacts an upper end portion of the first cam unit 32, the first cam unit 32 rotates in such a direction that the shaft 32*a* approaches the actuator 40*c*. The second cam unit 43 is pivotably supported on the first cam unit 32 with the shaft 32*a*. When the projection 24*a* of the right cover 24 contacts a lower end portion of the second cam unit 43 in FIG. 3, an upper end portion of the second cam unit 43 in FIG. 3 approaches the actuator 40*c*. The first cam unit 32 includes a first cam housing 41 and a first cam contact member 42. The first cam housing 41 includes bearing portions 41*c* and 41*d* (shown in FIGS. 5A and 5B), and the second cam unit 43 includes shafts 43*a* and 43*b* (shown in FIGS. 7A and 7B). The bearing portions 41*c* and 41*d* of the first cam unit 32, and the shafts 43*a* and 43*b* of the second cam unit 43, engaging each other, together form the shaft 32*a* of the first cam unit 32, which is described in further detail later. It is to be noted that, although projections 24*a* and 25*a* are pressed against the switch activation device 400 in the present embodiment, alternatively, the switch activation device 400 may be pressed by other pressing portions that operate in conjunction with opening and closing of the right cover 24 and the front cover 25, respectively. The interlock switch 40 includes two switches 401 and 402 shown in FIG. 11.

Referring to FIG. 3, a position restriction portion 30*b* and a positioning portion 30*c* are provided on the housing frame 30. The interlock switch 40 further includes, as switch-related portions, a positioning hole 40*a*, a long hole 40*b* for preventing rotation, the actuator 40*c*, a push switch 40*d*, and a connectors 40*e* (40*e*1 and 40*e*2). Additionally, the interlock switch 40 includes position restriction portions 41*e* and 41*f* in relation to the first cam housing 41. In FIG. 3, reference character 30*h* denotes a rotation restriction shaft.

Figure 4:
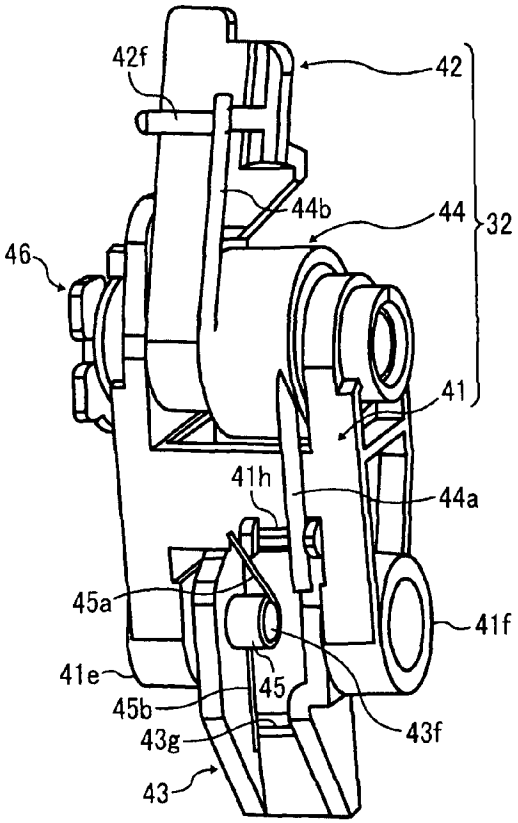
FIG. 4 is a perspective view of an assembly of a first cam unit and a second cam unit together forming the switch activation device shown in FIG. 3.

FIG. 4 illustrates configurations of the first cam unit 32 and the second cam unit 43 in further detail.

A lower end portion of the first cam contact member 42 of the first cam unit 32 is supported by the shaft 30*a* (shown in FIGS. 3 and 8), and the first cam contact member 42 is swingable around it. The first cam unit 32 is positioned such that the projection 25*a* of the front cover 25 can contact an upper end portion of the first cam contact member 42. The first cam housing 41 is swingable with an upper end portion thereof also supported by the shaft 30*a*, and the shaft 32*a* is positioned at a lower end portion of the first cam housing 41. The first cam unit 32 further includes a torsion spring 44 serving as an elastic member to urges the first cam housing 41 and the first cam contact member 42 to rotate opposite directions. At an initial state, a rotation limiter 41*g* (shown in FIG. 5A) of the first cam housing 41 is in contact with a strut portion 42*e* (shown in FIG. 6B) of the first cam contact member 42, and thus their relative positions are maintained. Instead of the torsion spring, the elastic member may be a tension spring. Alternatively, the first cam contact member 42 and the first cam housing 41 may be configured as a single unit made of an elastic material such as resin and elasticity thereof may be used. The torsion spring 44, however, is advantageous in that the mechanism can be compact.

In the assembled state shown in FIG. 4, an outer circumferential surface of a shaft receiving portion 42*a* of the first cam contact member 42 serves as a guide for the torsion spring 44, and the torsion spring 44 includes first and second arms 44*a* and 44*b* extending from the outer circumferential surface of the shaft receiving portion 42*a* in opposite directions. The first arm 44*a* of the torsion spring 44 contacts a spring receiving portion 41*h* of the first cam housing 41, and the second arm 44*b* thereof contacts a spring receiving portion 42*f* of the first cam contact member 42. With this configuration, the first cam housing 41 and the first cam contact member 42 of the first cam unit 32 bias each other in the opposite directions: in FIG. 4, the first cam housing 41 urges the first cam contact member 42 to rotate counterclockwise, and the first cam contact member 42 urges the first cam housing 41 to rotate clockwise.

In a configuration in which the shaft 30*a* is formed as a single unit with the housing frame 30 that is a mold structure as in the present embodiment, the strength and accuracy of the housing frame 30 should be relatively high, and thus glass-filled resin or the like is typically used. However, it is possible that such a material abrades typical resin when it contacts the resin slidingly, and deterioration over time can cause malfunction of the mechanism. Therefore, in the present embodiment, the shaft 30*a* is covered with a collar 46 (shown in FIG. 10) provided separately from and coaxially with the shaft 30*a*, and thus a sliding contact surface 46*a* is formed. The collar 46 includes an engagement portion 46*c* for preventing rotation that engages a rotation stopper 30*g* (shown in FIG. 8) of the housing frame 30 of the switch activation device 400. With this configuration, the collar 46 and the housing frame 30 do not slide with each other. It is preferred that the collar 46 be constructed of an abrasion-resistant material such as polyacetal.

Figure 7A:
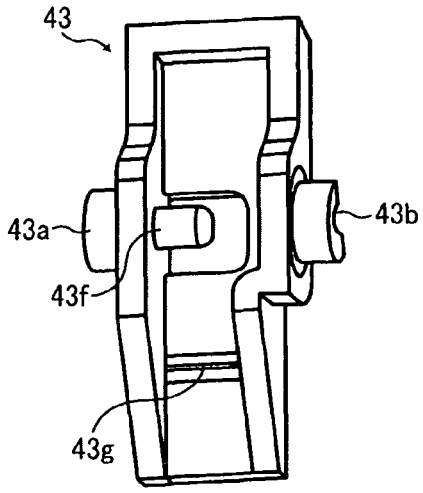
FIGS. 7A and 7B are perspective views of the second cam unit as viewed from the side similar to that shown in FIG. 4 and from the opposite side, respectively.
Figure 7B:
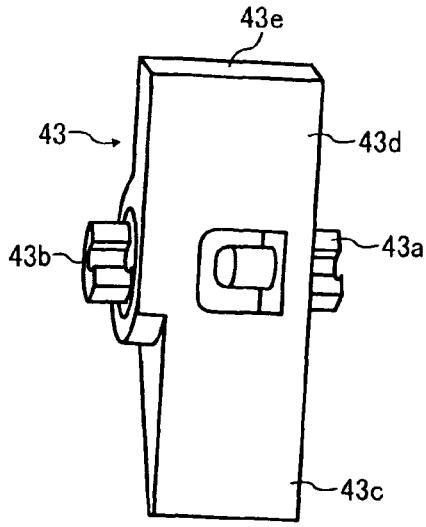
Figure 8:
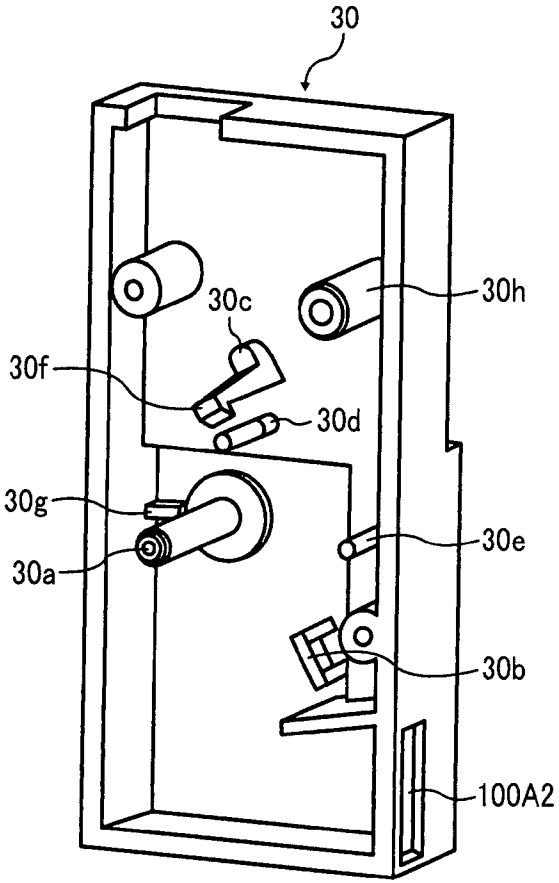
FIG. 8 is a perspective view that illustrates an interior of a housing frame of the switch activation device.
Figure 10:
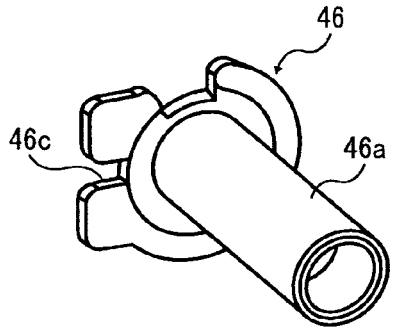
FIG. 10 is a perspective view of a collar.

Referring to FIGS. 7A and 7B, the shafts 43*a* and 43*b* of the second cam unit 43 fit in the bearing portions 41*c* and 41*d* (shown in FIGS. 5A and 5B) of the first cam housing 41, respectively, and a center portion of the second cam unit 43 is rotatable relative to the shaft 32*a*, which is on a common axial line. First and second cam surfaces 43*d* and 43*e* each having a cam shape to turn on the interlock switch 40 are formed in the upper end portion of the second cam unit 43, on the side of the first cam housing 41. Further, a sliding surface 43*c*, protruding downward in FIGS. 7A and 7B, that contacts the projection 24*a* is formed in the lower end portion of the second cam unit 43, on the side opposite the cam surfaces 43*d* and 43*e*. Additionally, the second cam unit 43 is biased in a predetermined direction constantly by a torsion spring 45 serving as an elastic bias member. The torsion spring 45 has a first arm 45*a* rested on a spring receiving portion 41*i* of the first cam housing 41 and a second arm 45*b*, the other arm, rested on the spring receiving portion 43*g* of the second cam unit 43. In other words, the second cam unit 43 is biased by the torsion spring 45 in the counterclockwise direction in FIG. 4 relative to the first cam housing 41. It is to be noted that the elastic bias member to bias the second cam unit 43 is not limited to the torsion spring 45 but may be a compression spring or a tension spring. However, when used for generating rotational force, a compression spring or a tension spring should be disposed away from the axis, making the apparatus larger. Therefore, in the present embodiment, a guide rod 43*f* is provided coaxially with the shaft 32*a* between the shafts 43*a* and 43*b* of the second cam unit 43, and the torsion spring 45 is provided on the guide rod 43*f*. Thus, the elastic bias force can be available while keeping the apparatus compact.

Thus, the guide rod 43*f* serves as a guide for the torsion spring 45, and the first and second arms 45*a* and 45*b* are in contact with the spring receiving portion 41*i* of the first cam housing 41 and the spring receiving portion 43*g* of the second cam unit 43, respectively. Since the guide rod 43*f* is coaxial with the shafts 43*a* and 43*b*, the second cam unit 43 is biased counterclockwise in FIG. 3, and a part of the second cam unit 43 comes into contact with a positioning portion 41*k* shown in FIG. 5B. Thus, the first cam housing 41 and the second cam unit 43 are held at constant relative positions on standby.

The configuration of the first cam unit 32 is described in further detail below.

Figure 5B:
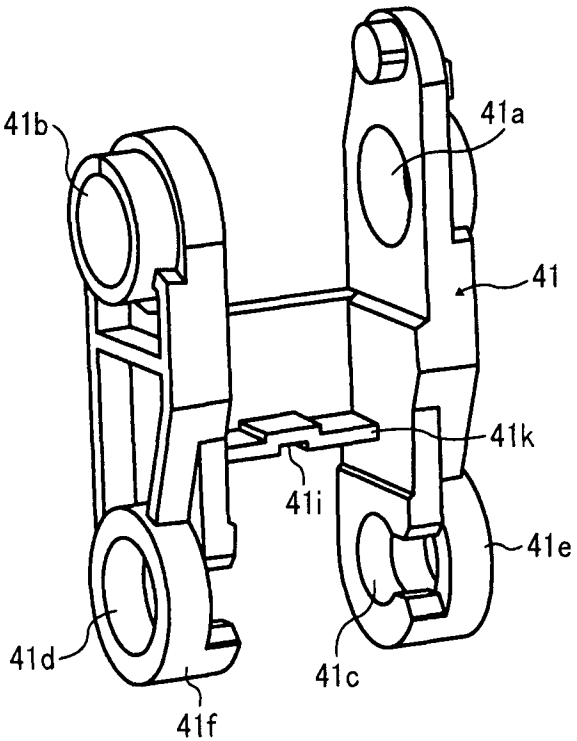
FIGS. 5A and 5B are perspective views of a housing of the first cam unit as viewed from a side similar to that shown in FIG. 4 and from the opposite side, respectively.
Figure 5A:
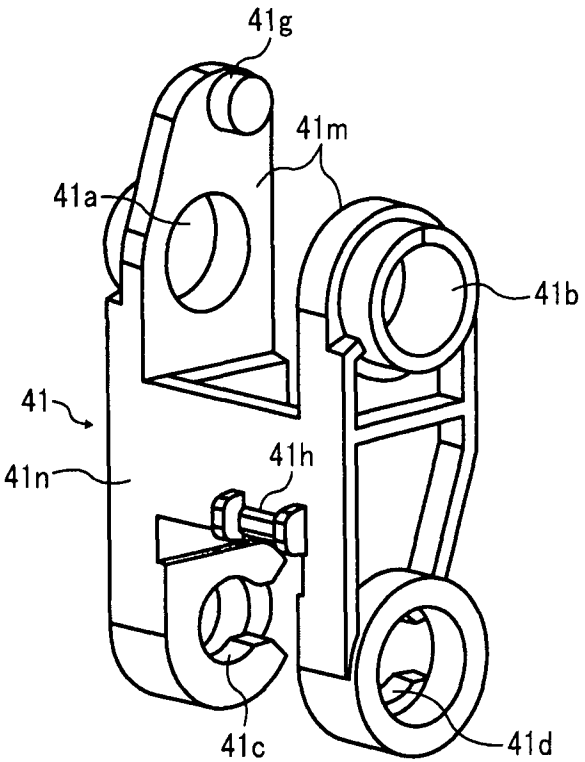

FIGS. 5A and 5B are perspective views of the first cam housing 41.

Referring to FIGS. 5A and 5B, the first cam housing 41 includes a pair of opposed side walls 41*m* connected via a connection wall 41*n*, and the bearing portions 41*c* and 41*d* (shaft supporters) into which the shafts 43*a* and 43*b* of the second cam unit 43 fit are provided in lower end portions of the respective side walls 41*m* across a predetermined space.

Further, bearing portions 41*a* and 41*b* are provided on the upper end portions of the respective walls 41*m* across a predetermined space, and the sliding contact surface 46*a* of the collar 46 (shown in FIG. 10) and the like penetrate the bearing portions 41*a* and 41*b*. The spring receiving portions 41*h* and 41*i* are provided on the connection wall 41*n*. The spring receiving portion 41*h* has a shape following a surface of the connection wall 41*n*, and the spring receiving portion 41*i* is curved inward from a surface of the connection wall 41*n*. In the configuration shown in FIG. 5A, an upper end portion, opposite the side (lower side) on which the bearing portion 41*c* is provided, of one of the side walls 41*m* (on the left in FIG. 5A) projects beyond the other side wall 41*m* (on the right in FIG. 5A), and the rotation limiter 41*g* is provided on an inner side of the projecting end portion of the left side wall 41*m*.

Figure 6A:
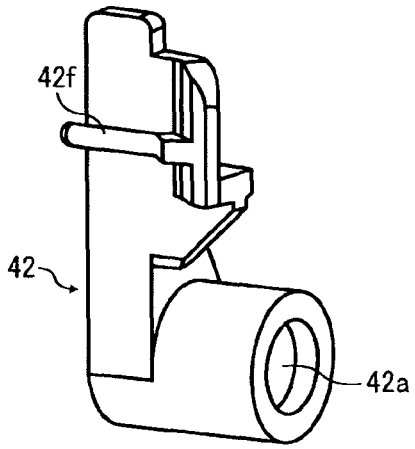
FIGS. 6A and 6B are perspective views of a first cam contact member of the first cam unit as viewed from the side similar to that shown in FIG. 4 and from the opposite side, respectively.
Figure 6B:
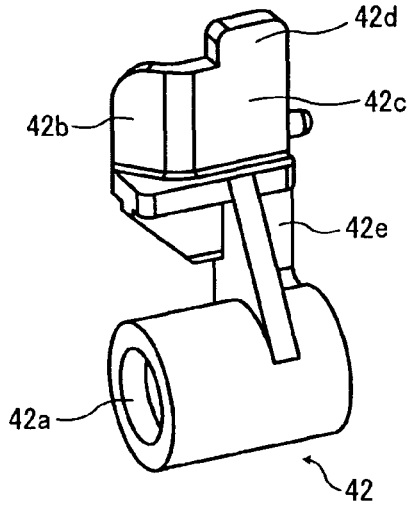

FIGS. 6A and 6B illustrate the first cam contact member 42.

Referring to FIGS. 6A and 6B, the first cam contact member 42 includes a shaft insertion portion 42*a* positioned in a lower end portion thereof, in the space between the bearing portions 41*a* and 41*b* of the first cam housing 41. The shaft insertion portion 42*a* fits around the sliding contact surface 46*a* of the collar 46 supported by those bearing portions. In an upper end portion of the first cam contact member 42, united with the shaft insertion portion 42*a* via the strut portion 42*e*, a first contact surface (cam surface) 42*b*, a second contact surface (sliding surface) 42*c*, and a contact portion 42*d* for a standby state (standby position) are provided. The face composed of the first contact surface 42*b* and the contact portion 42*d* is adjacent to and connected to the second contact surface 42*c* in the lateral direction in FIG. 6B, which crosses the direction in which the strut portion 42*e* extends. Since the first contact surface 42*b* is tapered, as the front cover 25 closes, the projection 25*a* comes into contact with the first contact surface 42*b* and causes the first cam contact member 42 to pivot counterclockwise in FIG. 3. When the projection 25*a* moves further inward and slides on the second contact surface 42*c* that is a straight surface, the first cam contact member 42 is not pushed beyond that position. When the front cover 25 is opened, the first cam housing 41 and the first cam contact member 42 of the first cam unit 32, the second cam unit 43, and torsion springs 44 and 45, serving as the elastic members, together operate as an integrated unit and pivots counterclockwise in FIG. 3 due to the rotation moment (torque) caused by its own weight. At that time, the contact portion 42*d* for the standby state comes into contact with the positioning portion 30*c* of the housing frame 30, and thus a position in the standby state can be determined. Additionally, a spring receiving portion 42*f* is provided laterally on the backside of the first contact surface 42*b*, the second contact surface 42*c*, and the contact portion 42*d*.

FIGS. 7A and 7B illustrate the second cam unit 43.

Figure 12A:
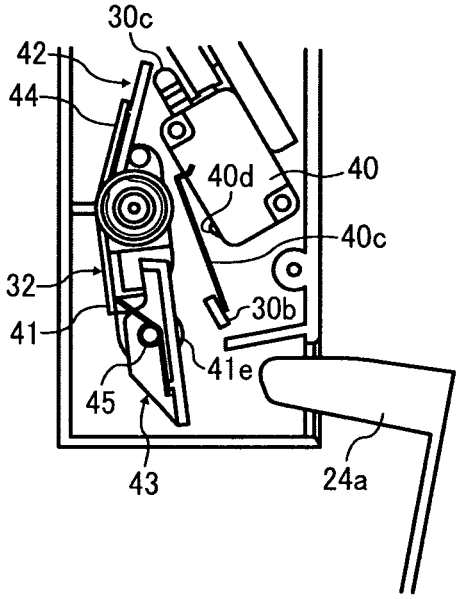
FIGS. 12A through 12D illustrate movement of the switch activation device when the front cover and the right cover are opened and closed.
Figure 12B:
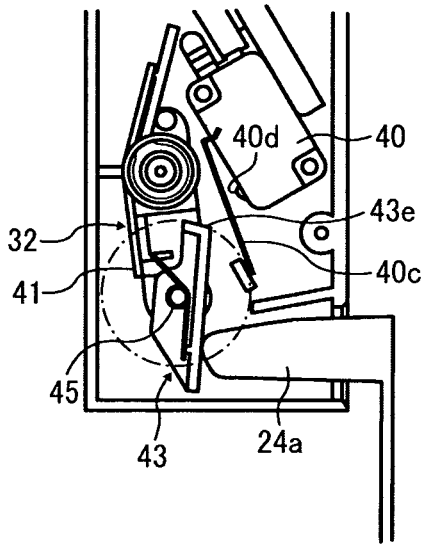

Referring to FIGS. 7A and 7B, the shafts 43*a* and 43*b* of the second cam unit 43, which are supported by the bearing portions 41*c* and 41*d* of the first cam housing 41 and positioned inside the space between these bearing portions 41*c* and 41*d*, are provided on either side wall of a center portion of a rectangular main body of the second cam unit 43 in the longitudinal direction thereof. Further, the guide rod 43*f* projecting from one of the side walls of the main body of the second cam unit 43 is positioned between the shafts 43*a* and 43*b*, coaxially with the shafts 43*a* and 43*b*, and the torsion spring 45 shown in FIG. 4 is provided around the guide rod 43*f*. The surface of the second cam unit 43 on the front side of the paper on which FIG. 7B is shown is flat, and a lower end portion of that surface serves as the sliding surface 43*c*. An upper portion of that surface serves as the first cam surface 43*d*, and an upper edge face perpendicular to the cam surfaces 43*d* serves as the second cam surface 43*e*. As it is clear from FIGS. 12A through 12D, the second cam surfaces 43*e* is arcuate, in particular, shaped like an arch concentric with the shafts 43*a* and 43*b*, and thus the entire cam surfaces 43*e* is at an identical or similar distance from the axis of rotation of the second cam unit 43 regardless of the rotational angle of the second cam unit 43 or the amount by which the second cam unit 43 rotates. Accordingly, as shown in FIG. 12B, when the right cover 24 is closed but the front cover 25 is not closed, the second cam unit 43 does not reach the actuator 40*c* no matter how far the second cam unit 43 rotates. By contrast, as shown in FIG. 12D, when the front cover 25 is closed and then the right cover 24 is pivoted a predetermined amount or more in the closing direction, the actuator 40*c* is pushed a constant amount.

When the second cam surfaces 43*e* is thus shaped like an arch concentric with the shaft supporting the second cam unit 43 (shafts 43*a* and 43*b*), the margin for the positional accuracy of the shaft supporting the second cam unit 43 can increase, and dimensional variations can be absorbed.

Figure 9:
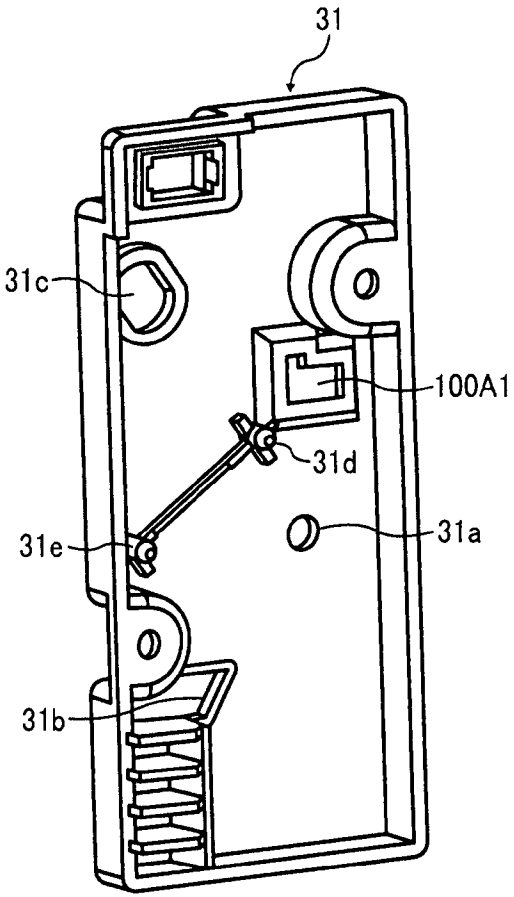
FIG. 9 is a perspective view that illustrates an interior of an interior cover of the housing frame shown in FIG. 8.

FIG. 8 illustrates an interior of the housing frame 30 of the switch activation device 400, and FIG. 9 illustrates an inner side of the interior cover 31.

When the housing frame 30 in which the components are assembled as shown in FIG. 3 is covered with the interior cover 31, the shaft 30*a* of the housing frame 30 fits into a positioning hole 31*a* formed in the interior cover 31, and the rotation restriction shaft 30*h* of the housing frame 30 fits into a rotation restriction hole 31*c* formed in the interior cover 31. Thus, relative positions of the housing frame 30 and the interior cover 31 are determined. Further, the interior cover 31 is screwed to the housing frame 30. Additionally, an alignment portion 30*b*, a positioning shaft 30*d*, a rotation restriction shaft 30*e*, and a holding pawl 30*f* are provided in the housing frame 30, and the opening 100A2 is formed in the side wall of the housing frame 30. The positioning shaft 30*d* and the rotation restriction shaft 30*e* respectively fit into the positioning hole 40*a* and the long hole 40*b* for preventing rotation formed in the interlock switch 40. This configuration can enhance accuracy in positioning the interlock switch 40 and secure rotation prevention. Further, the holding pawl 30*f* is hooked on the interlock switch 40, and thus the interlock switch 40 is fixed in place securely. Referring to FIG. 9, the interior cover 31 further includes a contact portion 31*b* that contacts the position restriction portion 41*f* of the first cam housing 41. The contact portion 31*b* and the alignment portion 30*b* provided on the housing frame 30 has surfaces that substantially parallel the actuator 40*c* at the on position to turn the interlock switch 40.

Figure 11:
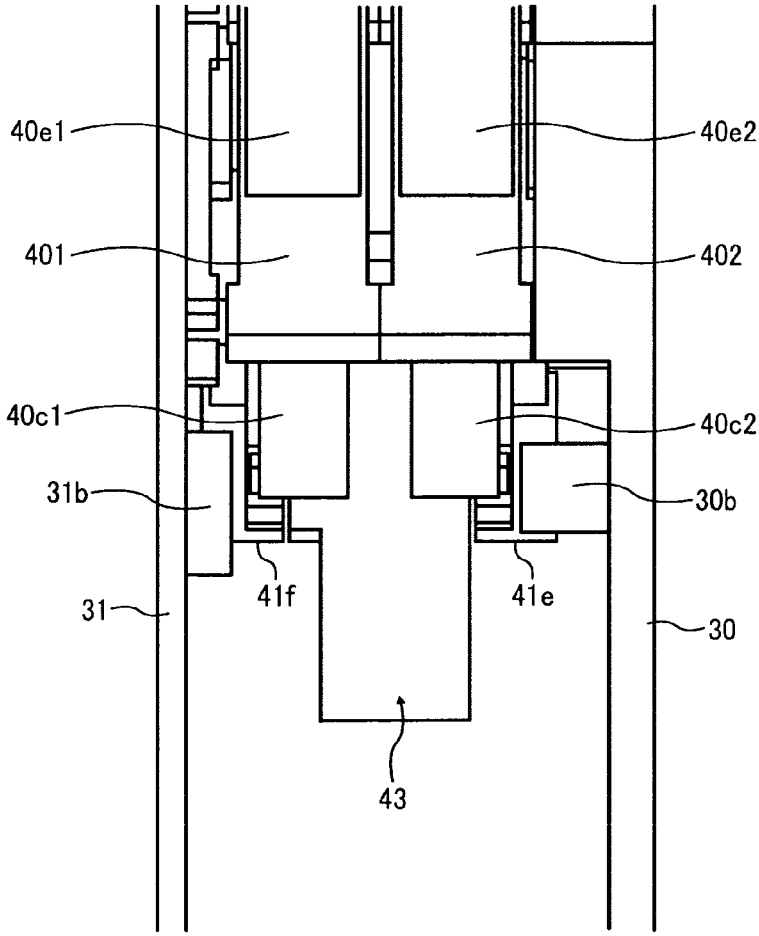
FIG. 11 is an enlarged view of a main portion of the interlock mechanism as viewed from the right in FIG. 3.

In the present embodiment, to reduce the cost, the positioning shaft 30*d* and the rotation restriction shaft 30*e* for positioning the interlock switch 40 are united with the housing frame 30 as a single unit. In this configuration, it is difficult to make the diameters of the positioning shaft 30*d* and the rotation restriction shaft 30*e* constant over the entire length with a high accuracy due to their draft. Accordingly, it is possible that the accuracy in positioning the switch 401, one of the two switches positioned farther from the housing frame 30 as shown in FIG. 11, is lower than the positioning accuracy of the other switch, the switch 402. Therefore, a positioning portion 31*d* and a rotation restriction portion 31*e* are provided on the interior cover 31 at the same positions as the positioning shaft 30*d* and the rotation restriction shaft 30*e*, respectively. Therefore, when the interior cover 31 is closed, the positioning portion 31*d* and the rotation restriction portion 31*e* can engage with respective engagement portions 40*c*1 of the actuator 40*c* shown in FIG. 11, holding the switch 401 with a higher accuracy.

An assembling procedure of the above-described components is described below. Initially, the shaft insertion portion 42*a* of the first cam contact member 42 is disposed between the bearing portions 41*a* and 41*b* of the first cam housing 41. Then, the shaft insertion portion 42*a* is fitted around the sliding contact surface 46*a* of the collar 46, which is inserted from the side of the bearing portion 41*a*. At that time, the torsion spring 44 is fitted around the outer circumferential surface of the shaft insertion portion 42*a*. The torsion spring 44 is disposed with the first arm 44*a* in contact with the spring receiving portion 41*h* of the first cam housing 41 and the second arm 44*b* in contact with the spring receiving portion 42*f* of the first cam contact member 42. Thus, the first cam housing 41, the first cam contact member 42, and the torsion spring 44 together form a common shaft, and the first cam unit 32 is assembled. Before or after this process, the second cam unit 43 is disposed between the bearing portions 41*c* and 41*d* of the first cam housing 41 such that the shafts 43*a* and 43*b* are supported by the bearing portions 41*c* and 41*d*, respectively. Then, the guide rod 43*f* provided on the second cam unit 43 is inserted in the torsion spring 45, and the first and second arms 45*a* and 45*b* of the torsion spring 45 are positioned in contact with the spring receiving portion 41*i* and the spring receiving portion 43*g*, respectively. Thus, the second cam unit 43 is attached to the first cam unit 32. This state is shown in FIG. 4.

Subsequently, the assembly of the first and second cam units 32 and 43 is attached to the housing frame 30 of the switch activation device 400. More specifically, the collar 46 in the assembly is fitted around the shaft 30*a* on the housing frame 30 shown in FIG. 8 from the side of the engagement portion 46*c*. FIG. 3 illustrates a state in which the assembly of the first and second cam units 32 and 43 is attached to the housing frame 30. In this state, the engagement portion 46*c* of the collar 46 engages the rotation stopper 30*g* of the housing frame 30, and thus the position thereof is determined. Further, the interlock switch 40, the actuator 40*c*, and the like are attached to the housing frame 30 at the respective predetermined positions as shown in the figures. Then, the interior cover 31 is attached to the housing frame 30 to cover the open side of the housing frame 30 with the shaft 30*a* inserted into the positioning hole 31*a*, which is the state shown in FIGS. 2A and 2B.

In the assembled state, the first cam unit 32 is biased clockwise in FIG. 3 by its own weight, and its upper end portion is in contact with the positioning portion 30*c* provided on the housing frame 30. Thus, the first cam unit 32 is retained at the initial position. Similarly, the upper end portion of the second cam unit 43 is in contact with the positioning portion 41*k*, and thus the second cam unit 43 is retained at the initial position. These positions are their home positions when the front cover 25 and the right cover 24 are open (an open state). It is to be noted that, although the self weight is used as the bias force in the description above, springs may be used for biasing the first cam unit 32 more positively in the desired direction when the self weight is insufficient or accuracy in operation should be improved.

Operation of the above-described interlock mechanism is described below.

Initially, operation of the first cam unit 32 is described below with reference to FIG. 3.

Figure 12C:
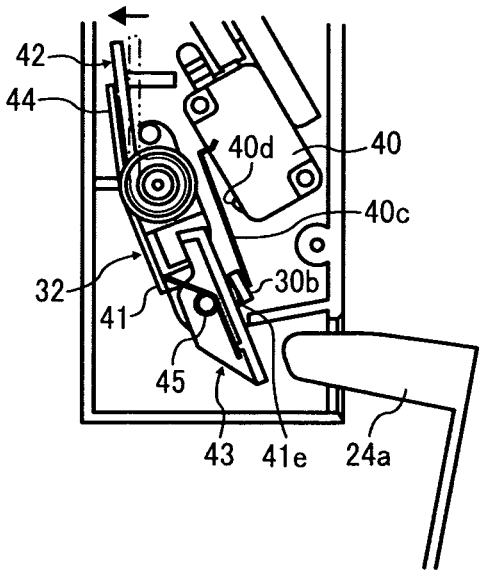
Figure 12D:
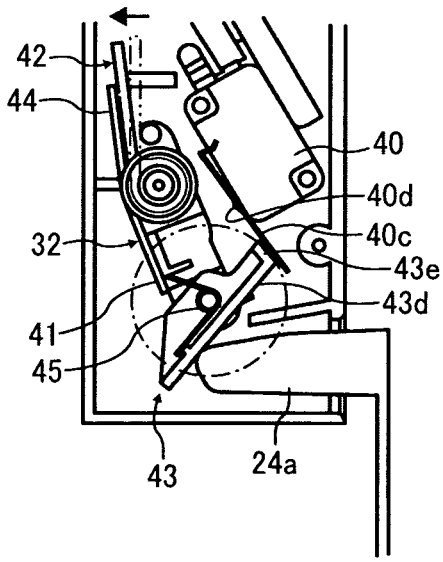

When the front cover 25 is pivoted in the closing direction (upward in FIG. 1), the projection 25*a* of the front cover 25 comes into contact with the first contact surface 42*b* of the first cam contact member 42, causing the first cam unit 32 to rotate gradually counterclockwise in FIG. 3 against the bias force exerted by the torsion spring 44, which is the state shown in FIG. 12C. When the first cam unit 32 has rotated a predetermined amount, the position restriction portions 41*e* and 41*f* of the first cam housing 41 respectively contact the alignment portion 30*b* provided on the housing frame 30 and the contact portion 31*b* provided on the interior cover 31. Thus, the first cam housing 41 stops moving. In other words, when the front cover 25 (first cover) is closed, the position of the first cam housing 41 is determined relative to the apparatus body 100A. Therefore, the accumulated dimensional variation is reduced, and the required accuracy of each component can be lower, reducing the cost.

When the front cover 25 is further rotated in the closing direction, only the first cam contact member 42 keeps rotating until the projection 25*a* slidingly contacts the second contact surface 42*c*. At that time, the torsion spring 44 can absorb the amount of the movement, enabling the first cam contact member 42 to rotate, and the load applied to the perspective portions can be relatively small.

FIG. 11 illustrates relative positions of the components in the direction of height as viewed from the right in FIG. 3.

The alignment portion 30*b* is positioned outside the second cam unit 43 not to hinder the rotation of the second cam unit 43.

Next, when the right cover 24 is pivoted in the closing direction (upward in FIG. 1), the projection 24*a* of the right cover 24 comes into contact with the sliding surface 43*c* of the second cam unit 43, rotating the second cam unit 43 clockwise in FIG. 3 against the bias force exerted by the torsion spring 45, which is the state shown in FIG. 12D. When the second cam unit 43 has rotated a predetermined amount, the first cam surface 43*d* of the second cam unit 43 pushes the actuator 40*c* to a predetermined position where the push switch 40*d* is pressed (on position), and thus the interlock switch 40 is turned on. As the right cover 24 is further rotated in the closing direction, the second cam surface 43*e* shaped into the arch concentric with the shafts 43*a* and 43*b* contacts the actuator 40*c*, and the actuator 40*c* is no longer pushed. Thus, an overload is not applied to the interlock switch 40, protecting the interlock switch 40 from damage.

FIGS. 12A through 12D illustrate the operation of the switch activation device 400 when the covers are opened or closed, and table 1 illustrates states of the front cover 25, the right cover 24, the interlock switch 40 in FIGS. 12A through 12D.

TABLE 1

| | Front cover | Right cover | Interlock switch |
|---|---|---|---|
| 12A | Open | Open | Off |
| 12B | Open | Closed | Off |
| 12C | Closed | Open | Off |
| 12D | Closed | Closed | On |

When the interlock switch 40 is on, the image forming apparatus can operate, and, when the interlock switch 40 is off, the image forming apparatus does not operate. More specifically, when the interlock switch 40 is off, the interlock switch 40 physically shuts off contacts for power supply to hazardous components such as motors, heaters, and laser diodes, thereby stopping the power supply thereto. It is to be noted that usable switches as the interlock switch 40 are those that satisfy the safety standards set in the country in which the interlock mechanism is sold.

Additionally, in the present embodiment, there are two systems using different voltages to be shut off by the interlock switch 40, and one switch (401 or 402) and one actuator (40*c*1 or 40*c*2) are used in each circuit. The two systems, however, are shut off at the same timing, and thus the single mechanism can shut off both simultaneously. It is to be noted that the number of switches is not limited two but varies depending on the circuit configuration, and the features of the present embodiment can adapt to such configurations, attaining similar effects.

FIG. 12A illustrates a state in which both the front cover 25 and the right cover 24 are open. In this state, the first cam unit 32 and the second cam unit 43 are retained at their initial position, and the interlock switch 40 is off.

FIG. 12B illustrates a state in which the right cover 24 is closed, but the front cover 25 is open. In this state, although the projection 24*a* of the right cover 24 contacts the sliding surface 43*c* of the second cam unit 43, the interlock switch 40 remains off because the rotation amount is small. When the first cam unit 32 is at the initial position, the shaft 32*a* is positioned so that the second cam surface 43*e* of the second cam unit 43 is kept off a tangent line to an off position of the actuator 40*c*. Therefore, the interlock switch 40 can be prevented from turning on even when the right cover 24 is closed abruptly, causing the second cam unit 43 to rotate due to an inertial force. Thus, the safety of the switch mechanism can be improved.

FIG. 12C illustrates a state in which the front cover 25 is closed, but the right cover 24 is open. In this state, although the projection 25*a* of the front cover 25 contacts the first contact surface 42*b* of the first cam unit 32, the interlock switch 40 remains off because the second cam unit 43 does not rotate in the direction to push the interlock switch 40. Additionally, because the first cam contact member 42 is pressed by the torsion spring 44 against the rotation limiter 41*g* (shown in FIG. 5A) of the first cam housing 41, the first cam contact member 42 and the first cam housing 41 can move as a single component. Accordingly, the first cam housing 41 rotates as the first cam contact member 42 rotates. After the first cam housing 41 contacts the alignment portion 30*b*, the torsion spring 44 can deform to absorb an over stroke.

FIG. 12D illustrates a state in which both the front cover 25 and the right cover 24 are closed. In this state, both projections 24*a* and 25*a* are push inward, and the first cam unit 32 and the second cam unit 43 move to the positions to push the actuator 40*c*, turning on the interlock switch 40. The second cam unit 43 is pressed by the torsion spring 45 against the rotation limiter 41*g* of the first cam housing 41. When the first cam contact member 42 rotates, the actuator 40*c* is pushed. After rotating a predetermined amount, the first cam contact member 42 contacts the actuator 40*c* in the circumferential direction and the amount by which the actuator 40*c* is pushed increases no further. Thus, an over stroke can be absorbed.

It is to be noted that the circle of broken lines shown in FIGS. 12B and 12D represent an extended locus of the second cam surface 43*e* of the second cam unit 43. In other words, in FIG. 12B, regardless of the amount by which the second cam unit 43 rotates, the second cam unit 43 neither reaches the actuator 40*c* nor pushes the interlock switch 40, and, in FIG. 12D, regardless of the amount by which the second cam unit 43 rotates, the actuator 40*c* is not pushed beyond the predetermined amount. Thus, damage to the actuator 40*c* can be prevented.

When the second cam unit 43 has rotated the predetermined amount, the first cam surface 43*d* of the second cam unit 43 pushes the actuator 40*c* to the on position, and the interlock switch 40 is turned on. As the right cover 24 is further rotated in the closing direction, the second cam surface 43*e* that is the cylindrical surface with the shaft 32*a* (43*a* and 43*b*) serving as its axis comes into contact with the actuator 40*c*, and the actuator 40*c* is no longer pushed. Thus, an overload is not applied to the interlock switch 40, protecting the interlock switch 40 from damage.

Figure 13:
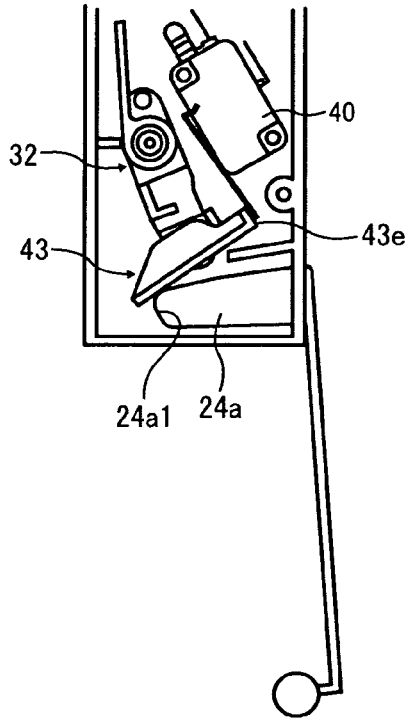
FIG. 13 is a perspective view illustrating first and second cam units according to another illustrative embodiment.

Additionally, as shown in FIG. 13, a surface 24*a*1 of the projection 24*a* provided on the right cover 24 that slidingly contacts the sliding surface 43*c* is shaped into an arc concentric with the center of rotation of the right cover 24. With this configuration, even when an impact is applied to the right cover 24, pushing the right cover 24 inward beyond the predetermined position, the second cam surface 43*e* of the second cam unit 43 that is in contact with the interlock switch 40 does not move or move only a limited amount. More specifically, because the amount by which the second cam unit 43 pushes the interlock switch 40 is not changed, the second cam unit 43 can be prevented from moving excessively and hitting other components. Therefore, damage to the interlock switch 40 as well as the switch activation unit 400 can be prevented. Further, sliding contact between them can be minimized. Thus, durability of the switch mechanism can be improved.

Additionally, when the surface 24*a*1 of the projection 24*a* (second pressing portion) is arced, dimensional variations can be absorbed, and required dimensional accuracy of the second cover and other components can be lowered, reducing the cost.

Next, a second embodiment is described below with reference to FIG. 14.

Figure 14:
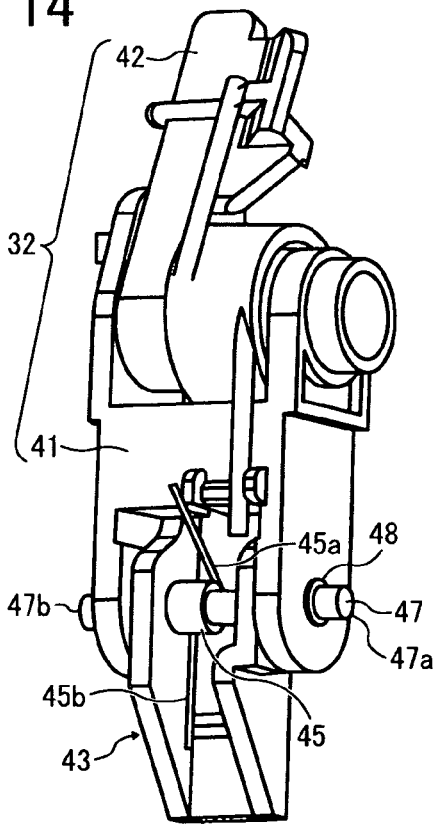
FIG. 14 illustrates operation of the first and second cam units shown in FIG. 13.

Referring to FIG. 14, the first cam unit 32 and the second cam unit 43 are supported by a shaft 47 in the second embodiment. The shaft 47 is fixed in the thrust direction by an E-ring 48 and serves as a guide for the torsion spring 45. The shaft 47 is designed so that axial end portions 47*a* and 47*b* thereof can contact the alignment portion 30*b* on the housing frame 30 and the contact portion 31*b* on the interior cover 31, respectively.

With this configuration, the axis of the second cam unit 43 can be identical to the axis of positioning, thus enhancing reliably and reducing variation in the dimension of the switch activation device.

In the above-described embodiment, the first cam unit 32 absorbs over strokes in positioning the first cam housing 41 when the front cover 25 is closed. Although, needless to say, over strokes may be absorbed on the side of the projection 25*a* of the front cover 25, providing a complicated structure on the exterior cover side (the side of the housing frame 30) can increase possibility of a surface sink. In such a case, considering the appearance, it is necessary to use a slide mechanism or molding such as gas molding, which increase the cost of the components. Therefore, providing the over-stroke absorption on the main body side is advantageous in terms of the cost.

As described above, in the above-described configuration, when the first and second pressing portions respectively contact the first and second cam units, the first cam unit and the second cam unit pivot in the direction to push the interlock switch, and then the second cam unit turns on the interlock switch. Thus, closing of the first and second covers can be detected simultaneously. Therefore, the interlock switch is turned on, enabling the apparatus to operate, when both covers are closed. By contrast, when either cover is opened, the interlock switch is turned off, deactivating the apparatus. Thus, the interlock switch can be turned on and off reliably. Additionally, the possibility of the interlock switch being damaged is small. Further, the mechanism can be compact and have a higher accuracy because only one interlock switch is required.

Additionally, because the over stroke absorption can be provided on the apparatus body in the above-described embodiments, a compact mechanism having a higher accuracy can be attained at a lower cost. By contrast, if the over stroke absorption is provided on the covers, additional components are required because the covers are generally formed integrally, and accordingly design flexibility of the mold is small.

Numerous additional modifications and variations are possible in light of the above teachings. It is therefore to be understood that, within the scope of the appended claims, the disclosure of this patent specification may be practiced otherwise than as specifically described herein.

What is claimed is:

1. An interlock mechanism comprising:

a first cover hinged to an apparatus body and openably closable relative to the apparatus body;

a second cover hinged to the apparatus body and openably closable relative to the apparatus body;

an interlock switch provided inside the first cover and the second cover in the apparatus body;

a first pressing portion provided on the first cover;

a second pressing portion provided on the second cover;

a first cam unit pivotably supported on the apparatus body by a first shaft provided on the apparatus body to contact the first pressing portion in a state in which the first cover is closed; and a second cam unit pivotably supported on the first cam unit by a second shaft to contact the second pressing portion in a state in which the second cover is closed;

wherein, when the first pressing portion contacts the first cam unit and the second pressing portion contacts the second cam unit, the first cam unit and the second cam unit rotate to push the interlock switch, the second cam unit turns on the interlock switch, and the closing of the first and second covers are detected simultaneously.

2. The interlock mechanism according to claim 1, wherein the first cam unit comprises:

a first cam contact member having a first end portion pivotably supported by the first shaft of the apparatus body and a second end portion opposite the first end portion, the second end portion including a first cam surface that contacts the first pressing portion provided on the first cover;

a first cam housing having a first end portion supported on the first cam contact member with the first shaft and a second end portion opposite the first end portion, the second end portion including a support portion to support the second cam unit, and a first elastic member to apply reaction forces to the first cam contact member and the first cam housing.

3. The interlock mechanism according to claim 2, wherein the second cam unit comprises:

a first end portion on the side of the first cam housing, the first end portion including a second cam surface to push the interlock switch to turn on the interlock switch;

a second end portion opposite the first end portion of the second cam unit, the second end portion including a receiving surface to contact the second pressing portion; and a second elastic member to apply reaction forces to the second cam unit and the first cam housing, wherein the support portion of the first cam housing of the first cam unit pivotably supports the second cam unit at a center portion of the second cam unit.

4. The interlock mechanism according to claim 3, wherein closing of the first cover determines the position of the first cam housing relative to the apparatus body.

5. The interlock mechanism according to claim 3, wherein the second pressing portion comprises an arcuate surface that contacts the receiving surface of the second cam unit.

6. The interlock mechanism according to claim 3, wherein the second cam surface of the second cam unit comprises an arc concentric with the first shaft of the apparatus body.

7. The interlock mechanism according to claim 3, wherein the first elastic member and the second elastic member are torsion springs.

8. The interlock mechanism according to claim 1, further comprising an actuator positioned between the interlock switch and the second cam unit that turns on the interlock switch when pushed by the second cam unit, wherein a position of the second shaft that supports the second cam unit is determined by a positioning portion provided in the apparatus body, the positioning portion having a face substantially parallel to the actuator when the actuator is at a on position for turning on the interlock switch.

9. The interlock mechanism according to claim 1, wherein the second pressing portion comprises an arcuate surface that contacts the second cam unit.

10. The interlock mechanism according to claim 1, wherein the second cam unit comprises an arc concentric with the first shaft of the apparatus body to contact the interlock switch.

11. The interlock mechanism according to claim 1, wherein the second cover is adjacent and perpendicular to the first cover.

12. An image forming apparatus comprising:

an image forming unit to form an image on a sheet of recording media; and an interlock mechanism comprising:

a first cover hinged to an apparatus body and openably closable relative to the apparatus body;

a second cover hinged to the apparatus body and openably closable relative to the apparatus body;

an interlock switch provided inside the first cover and the second cover in the apparatus body;

a first pressing portion provided on the first cover;

a second pressing portion provided on the second cover;

a first cam unit pivotably supported on the apparatus body by a first shaft provided on the apparatus body, to contact the first pressing portion in a state in which the first cover is closed; and a second cam unit pivotably supported on the first cam unit by a second shaft to contact the second pressing portion in a state in which the second cover is closed;

wherein, when the first pressing portion contacts the first cam unit and the second pressing portion contacts the second cam unit, the first cam unit and the second cam unit rotate to push the interlock switch, and the second cam unit turns on the interlock switch.

* * * * *